US008002212B2

(12) United States Patent
Zhong

(10) Patent No.: US 8,002,212 B2
(45) Date of Patent: Aug. 23, 2011

(54) DOUBLE-FUNCTIONAL ROLLING BLADE WHEEL GROUP AND MULTI-FUNCTIONAL SHREDDER

(76) Inventor: Fengqiang Zhong, Guangzhou (CN)

( * ) Notice: Subject to any disclaimer, the term of this patent is extended or adjusted under 35 U.S.C. 154(b) by 309 days.

(21) Appl. No.: 12/273,549

(22) Filed: Nov. 19, 2008

(65) Prior Publication Data

US 2009/0127364 A1 May 21, 2009

(30) Foreign Application Priority Data

Nov. 20, 2007 (CN) ..... 2007 2 0059829 U

(51) Int. Cl.
*B02B 7/02* (2006.01)
*B02C 23/00* (2006.01)

(52) U.S. Cl. ..... 241/100; 241/236

(58) Field of Classification Search ..... 241/100, 241/236

See application file for complete search history.

(56) References Cited

U.S. PATENT DOCUMENTS

| | | | | |
|---|---|---|---|---|
| 5,039,020 | A * | 8/1991 | Leuthold et al. | 241/30 |
| 5,342,582 | A * | 8/1994 | Horn et al. | 422/105 |
| 5,662,281 | A * | 9/1997 | Wollert et al. | 241/100 |
| 5,871,162 | A * | 2/1999 | Rajewski | 241/100 |
| 6,676,050 | B2 * | 1/2004 | Chang | 241/37.5 |
| 6,802,465 | B1 * | 10/2004 | Norcott et al. | 241/36 |
| 2005/0161541 | A1 * | 7/2005 | Lo | 241/236 |
| 2006/0038048 | A1 * | 2/2006 | Lo | 241/100 |
| 2009/0095829 | A1 * | 4/2009 | Huang | 241/100 |

* cited by examiner

*Primary Examiner* — Bena Miller

(57) ABSTRACT

The present invention provides a double-functional rolling blade wheel group having two rolling blade wheels. Each of the rolling blade wheels includes a number of rolling blades arranged in a longitudinal direction thereof. The rolling blades of one rolling blade wheel cooperate with the rolling blades on the other rolling blade wheel, so as to shred objects. Each of the rolling blade wheels forms at least two shredding areas along the longitudinal direction thereof. The number of blade rows along a circumference direction of one shredding area and the number of the rolling blades in each blade row along the longitudinal direction of the shredding area are different from those formed on the other shredding area.

4 Claims, 5 Drawing Sheets

DOUBLE-FUNCTIONAL ROLLING BLADE WHEEL GROUP AND MULTI-FUNCTIONAL SHREDDER

CROSS REFERENCE TO RELATED APPLICATIONS

The present invention claims priority to Chinese Patent Application No. CN 200720059829.4 filed Nov. 20, 2007, which is incorporated by reference herein in its entirety.

FIELD OF THE INVENTION

The present invention relates to multi-functional shredders and a rolling blade wheel group for use in the multi-functional shredders.

BACKGROUND OF THE INVENTION

Conventionally, a paper shredding mechanism used in a shredder includes two rolling blade wheels parallel and adjacent to each other. Each of the rolling blade wheels each is provided with a number of rolling blades on the columnar surface thereof. One rolling blade wheel actuates the other rolling blade wheel via a gear mechanism. The rolling blades on one rolling blade wheel are staggered to and match to the rolling blades formed on the other rolling blade wheel, thereby forming a shearing and cutting effect to chop papers or other objects.

Currently, shredders with double feeding openings are designed to chop paper documents and rigid/semi-rigid objects, such as compact discs. However, in this kind of shredder, the functions of shredding paper documents and the rigid/semi-rigid objects are specially emphasized, while other performances of the shredders are neglected.

Typically, a known shredder having two rolling blade wheel groups is used to shred paper and/or compact discs, respectively. Each rolling blade wheel is provided with an opening. However, in the shredder as previously mentioned, evenly distributing power cannot be realized, which will lead to imbalance of the shredder. Consequently, during operation of the shredder, the power imbalance causes barycenter imbalance and unstable running of the shredder, which will inevitably decreases the lifespan of the shredder.

Another known shredder having two shredding mechanisms formed by three rolling blade wheels can also be utilized to shred compact discs and/or paper documents. However, on one hand, rigidity of the rolling blades for shredding paper documents is different from that for shredding compact discs. On the other hand, if the rolling blades used to shred paper documents are frequently used to shred compact discs, the rolling blades would be passivated, which will remarkably decrease the lifespan of the shredder.

Furthermore, in the above-mentioned two kinds of shredders, driving rolling blade wheels are introduced, which will certainly increases volume of the shredders along the arrangement direction of the driving rolling blade wheels and, therefore, increases the volume of the whole shredder.

What is needed, therefore, is to provide a new multifunctional shredder which can solve the shortcomings of the conventional shredders as previously set forth.

SUMMARY OF THE INVENTION

One object of the present invention is to overcome the shortcomings as set forth above and to provide a double-functional rolling blade wheel group without arrangement of a third driving rolling blade wheel.

Another object of the present invention is to provide a multi-functional shredder having a simple configuration, a reasonable inner space and a long lifespan.

To fulfill the objects as set forth previously, the present invention provides a double-functional rolling blade wheel group including two rolling blade wheels. Each of the rolling blade wheels forms a number of rolling blades arranged along a longitudinal direction on a columnar surface thereof. The rolling blade wheels each form at least two shredding areas. The number of blade rows in a circumference direction of one shredding area and the number of the rolling blades in each of the blade rows along the longitudinal direction of one shredding area are different from those disposed on the other shredding area.

A multifunctional shredder of the present invention includes a shell and a shredding mechanism housed in the shell. The shredding mechanism includes at least one double-functional rolling blade wheel group as previously described. The shell defines feeding openings corresponding to the rolling blade wheels, respectively. The shell forms a plate extending into the feeding openings to divide the feeding openings into at least two openings.

In the shredder in accordance with the present invention, the double-functional rolling blade wheel is used to perform two different cutting functions without remarkably increasing the volume of the shredder.

A shredder in accordance with another embodiment of the present invention generally includes a shell and a shredding mechanism housed in the shell. The shredding mechanism includes a motor, a first rolling blade wheel group, a second rolling blade wheel group, a gear, a first driving mechanism and a second driving mechanism. Output axis of the motor is coupled to the gear. The gear is coupled to the first driving mechanism and the second driving mechanism, respectively. The first driving mechanism and the second driving mechanism correspondingly connect with the first rolling blade wheel group and the second rolling blade wheel group. The shell defines feeding openings corresponding to the first rolling blade wheel group and the second rolling blade wheel group.

To balance the force exerted on the shredding mechanism, the motor is disposed in a middle portion between the first rolling blade wheel group and the second rolling blade wheel group.

To improve the performance of the shredder, a third rolling blade wheel group is introduced into the shredding mechanism. The third rolling blade wheel group is located between the first and the second rolling blade wheel groups and juxtaposed to the motor. A third driving mechanism is provided to connect the third rolling blade wheel group with the first rolling blade wheel group or the second rolling blade wheel group. The shell defines feeding opening corresponding to the third rolling blade wheel group.

Preferably, the number of blade rows in a circumferential direction of the first rolling blade wheel group and the number of rolling blades in each blade row along the longitudinal direction of the first rolling blade wheel group are different from those of the second rolling blade wheel group. Via adjusting the arrangement and the number of the blade rows and the rolling blades, the shredder can shred different objects into pieces of different sizes.

Preferably, the first driving mechanism and second driving mechanism are both configured as gears.

Preferably, at least one of the rolling blade wheel groups is configured as the double-functional rolling blade wheel group as previously described.

Alternatively, in at least one of the first and second driving mechanisms, the gear can also be replaced by a belt or a chain. One end of the belt or the chain connects to one rolling blade wheel, while the other end of the belt or the chain connects with a gear of another driving mechanism. As such, different configuration selections for the driving mechanisms are provided.

Compared with conventional shredders, the shredders of the present invention have small size, balanced power and optimized inner space and, therefore, facilitate the shredder to meet different requirements of applications.

Other advantages and novel features will be drawn from the following detailed description of preferred embodiments with the attached drawings, in which:

DETAILED DESCRIPTION OF TIE INVENTION

References will now be made to the drawings and embodiments of the present invention to describe the spirit of the present invention in detail.

Figure 1:
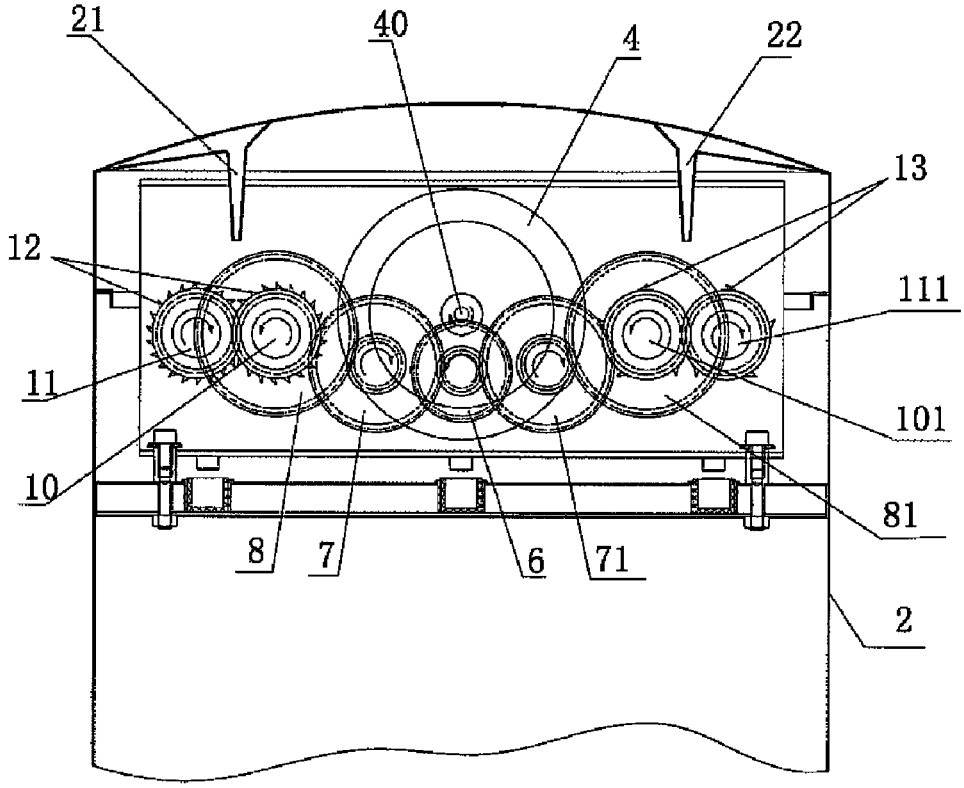
FIG. 1 depicts a side plane view of a shredding mechanism for use in a shredder according to a first embodiment of the present invention.
Figure 2:
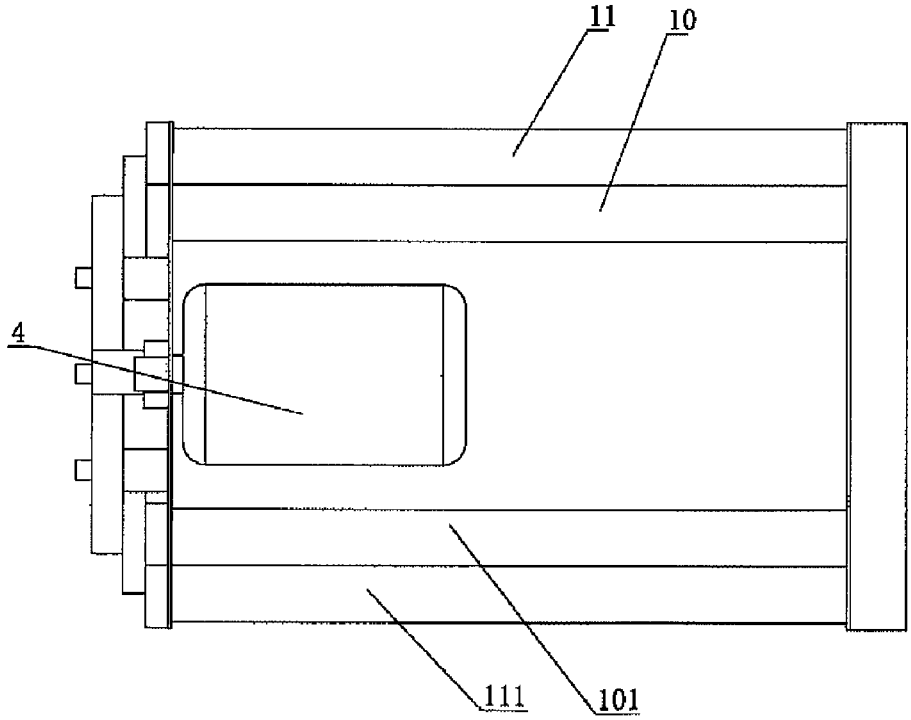
FIG. 2 depicts a top plane view of the shredding mechanism shown in FIG. 1.

Referring to FIGS. 1 and 2, FIG. 1 depicts a plane view of a part of a shredder in accordance with a first embodiment of the present invention, illustrating a shredding mechanism and a shell 2 for housing the shredding mechanism.

The shredding mechanism generally includes a motor 4, a first rolling blade wheel group 10, 11, a second rolling blade group 101, 111, a main gear 6, a first driving mechanism 7, 8, and a second driving mechanism 71, 81.

Referring particularly to FIG. 2, the first driving mechanism 7, 8 and the second driving mechanism 71, 81 are arranged symmetrically with respect to the main gear 6. The motor 4 drives the main gear 6 via an output axis 40 thereof. The motor 4 is disposed between the first driving mechanism 7, 8 and the second driving mechanism 71, 81 and, also, disposed between the first rolling blade wheel group 10, 11 and the second rolling blade wheel group 101, 111.

The first driving mechanism 7, 8 includes a first passive gear 8 and a first connecting gear 7. The first passive gear 8 matches to a rolling blade wheel 10 of the rolling blade wheel group 10, 11. The first connecting gear 7 gears to the main gear 6 and the first passive gear 8. The main gear 6, the first connecting gear 7 and the first passive gear 8 engage with each other in turn, thereby facilitating the motor 4 to drive the first rolling blade wheel group 10, 11.

In the same manner, the second driving mechanism 71, 81 includes a second passive gear 81 and a second connecting gear 71. The second passive gear 81 matches to a rolling blade wheel 101 of the second rolling blade wheel group 101, 111. The second connecting gear 71 gears to the main gear 6 and the second passive gear 81. The main gear 6, the second connecting gear 71 and the second passive gear 81 engage with each other in turn, thereby facilitating the motor 4 to actuate the second rolling blade wheel group 101, 111.

In view of the above description, the main gear 6 is configured to connect the first driving mechanism 7, 8 and the second driving mechanism 71, 81 to the output axis 40 of the motor 4. Therefore, according to the driving mechanisms 7, 8, 71, 81 of the present invention, speeds of the rolling blade wheel groups can be changed via increasing or decreasing the number of the gears. However, as an advantage of the present invention, it is understood that the motor 4 should be arranged on the middle portion between the first rolling blade wheel group 10, 11 and the second rolling blade wheel group 101, 111 and, similarly, the first driving mechanism 7, 8 and the second driving mechanism 71, 81 should be arranged in a symmetrical manner.

The first rolling blade wheel group 10, 11 has a configuration similar to that of the second rolling blade wheel group 101, 111.

The first rolling blade wheel group 10, 11 includes a first driving rolling blade wheel 10 and a first passive rolling blade wheel 11 having a diameter as same as that of the first driving rolling blade wheel 10. The first driving rolling blade wheel 10 directly connects with the first passive gear 8 of the first driving mechanism 7, 8. The first driving rolling blade wheel 10 and the first passive rolling blade wheel 11 are disposed in a horizontal plane and adjacent to each other. When objects, for instance paper documents, is fed between the first driving rolling blade wheel 10 and the first passive rolling blade wheel 11, rolling blades formed on the columnar surfaces of the first driving rolling blade wheel 10 and the first passive rolling blade wheel 11 match to each other to chop the objects.

Similarly, the second rolling blade wheel group 101, 111 includes a second driving rolling blade wheel 101 and a second passive rolling blade wheel 111 having a diameter as same as that of the second driving rolling blade wheel 101. The second driving rolling blade wheel 101 connects with the second passive gear 81 of the second driving mechanism 71, 81 directly or indirectly. The second driving rolling blade wheel 101 and the second passive rolling blade wheel 111 are disposed in a horizontal plane and close to each other. When objects is fed between the second driving rolling blade wheel 101 and the second passive rolling blade wheel 111, rolling blades formed on columnar surfaces of the second driving rolling blade wheel 101 and the second passive rolling blade wheel 111 match to each other to chop the objects.

As it is known, each of the rolling blade wheel of the first rolling blade wheel group 10, 11 and the second rolling blade wheel group 101, 111 has a circumferential direction and a longitudinal direction. Along the circumferential direction, each of the rolling blade wheels forms a number of blade rows 12 thereby forming teeth arranged along a circumferential cross-section of the rolling blade wheels. In the longitudinal direction, each of the blade rows 12 forms a number of rolling blades (the rolling blades in the longitudinal direction not shown in FIG. 2). In each of the rolling blade wheel groups, the number of the blade rows and the number of the rolling blades in each blade row of the driving rolling blade wheel are corresponding to that of the passive rolling blade wheel. The rolling blades of the driving rolling blade wheel stagger with and match to the rolling blades on the passive rolling blade wheel. Consequently, when the driving rolling blade wheel rotates relative to the passive rolling blade wheel, the rolling blades of them engage with each other to chop the objects.

In the first embodiment of the present invention, the number of the blade rows 12 and the number of the rolling blades in each blade row of the first rolling blade wheel group 10, 11 are different from those of the second rolling blade wheel group 101, 111. For instance, the rolling blades of the first rolling blade wheel group 10, 11 are disposed in a compact manner and the rolling blades 13 of the second rolling blade wheel group 101, 111 are disposed in a thin manner. As such, in shredding operation, shredded pieces formed by the first rolling blade wheel group 10, 11 are smaller than those formed by the second rolling blade wheel group 101, 111. For confidential paper documents, the first rolling blade wheel group 10, 11 is a preferable selection. Alternatively, one rolling blade wheel group could be used to shred paper, while the other rolling blade wheel group can be used to shred rigid/semi-rigid objects, such as compact discs or credit cards.

The shell 2 is provided with feeding openings 21, 22 corresponding to the first rolling blade wheel group 10, 11 and the second rolling blade wheel group 101, 111 respectively. Therefore, the objects can be fed into the rolling blade wheel groups through corresponding feeding openings 21, 22.

Referring again to FIG. 2, the rolling blade wheel groups 10, 11, 101, 111 are formed on two opposite sides of the motor 4. When the first rolling blade wheel group 10, 11 rotates to shred objects, the second rolling blade wheel group 101, 111 rotate along a counter direction to relieve the objects. Contrarily, when the first rolling blade wheel group 10, 11 rotates to relieve the objects, the second rolling blade wheel group 101, 111 rotates to shred the objects. Therefore, only one rolling blade wheel may be used to shred the objects. Alternatively, a programmed control chip can be introduced into the shredder of the present invention to automatically detect the state of the shredder and control the rotation of the first rolling blade wheel group 10, 11 and the second rolling blade wheel group 101, 111.

Referring to FIGS. 1 and 2, the illustrated shredder of the present invention has a stable machine configuration designed according to a balance theory. The motor 4 set in the middle portion and the symmetrically arranged driving mechanisms 7, 8, 71, 81 can ensure a power balance of the shredding mechanism, thereby prolonging the lifespan of the shredder.

Figure 3:
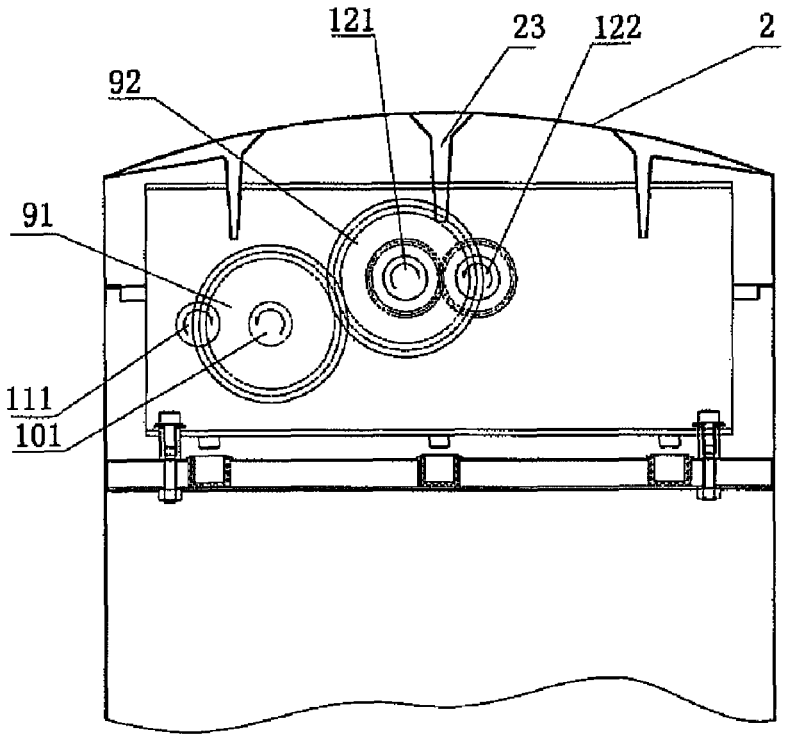
FIG. 3 depicts a side plane view of a shredding mechanism for use in a shredder in accordance with a second embodiment of the present invention, showing the shredding mechanism from a side opposite to that of FIG. 1.
Figure 4:
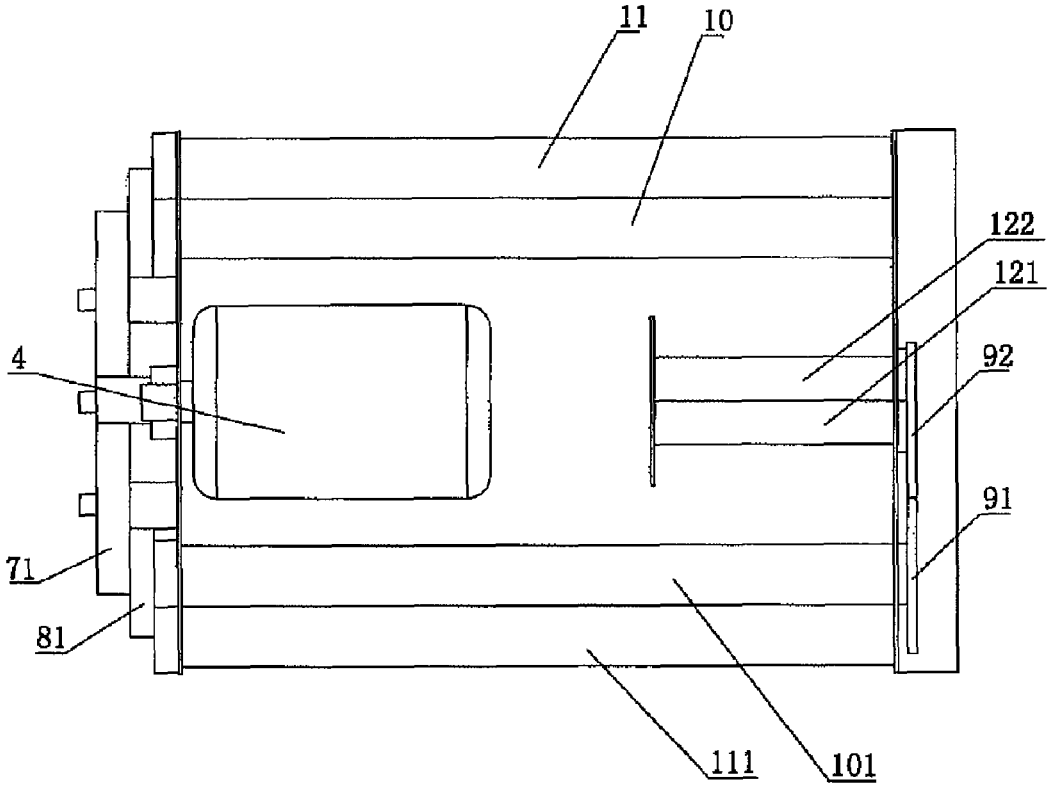
FIG. 4 depicts a top plane view of the shredding mechanism shown in FIG. 3.

FIGS. 3 and 4 further illustrate a second embodiment of the present invention. It should be noticed that FIG. 3 depicts a side view of a shredding mechanism according to a second embodiment of the present invention, illustrating the improvements of the shredding mechanism from a side opposite to that shown in FIG. 1.

In the top side view as shown in FIG. 4, a third rolling blade wheel group 121, 122 is introduced. The theory of the third rolling blade wheel group 121, 122 is similar to that of the first and second rolling blade wheel groups 10, 11, 101, 111. The number of the blade rows and the number of rolling blades in each blade row of the third rolling blade wheel group 121, 122 are different from those of the first rolling blade wheel group 10, 11 and those of the second rolling blade wheel group 101, 111, thereby shredding objects different from the objects which can be shredded by the first rolling blade wheel group 10, 11 and the second rolling blade wheel group 101, 111.

To drive the third rolling blade wheel group 121, 122, a third driving mechanism 91, 92 is provided. As shown in FIGS. 3 and 4, the third driving mechanism 91, 92 connects the second rolling blade wheel group 101, 111 with the third rolling blade wheel group 121, 122. The third driving mechanism 91, 92 includes two same gears, with one gear connecting with one rolling blade wheel 111 of the second rolling blade wheel group 101, 111 while the other gear connecting with one rolling blade wheel 121 of the third rolling blade wheel group 121, 122. Thus, rotation of the motor 4 would drive the third rolling blade wheel group 121, 122 to synchronously rotate with the second rolling blade wheel group 101, 111. The third rolling blade wheel group 121, 122 is generally used to chop objects with small width (e.g., compact discs, credit cards). Thus, the third rolling blade wheel group 121, 122 is juxtaposed to the motor 4 and disposed between the first rolling blade wheel group 10, 11 and the second rolling blade wheel group 101, 111, so as to decrease the volume of the shredder (as illustrated in FIG. 4). The shell 2 of the shredder also defines a feeding opening corresponding to the third rolling blade wheel group 121, 122.

Referring to FIGS. 3 and 4, in the second embodiment, the third rolling blade wheel group 121, 122 synchronously rotates with the second rolling blade wheel group 101, 111 to perform shredding. It is understood that, if the third driving mechanism 91, 92 connects the third rolling blade wheel group 121, 122 with the first rolling blade wheel group 10, 11, the third rolling blade wheel group 121, 122 can synchronously rotate with the first rolling blade wheel group 10, 11.

Relatively, with reasonable inner space, the shredder according to the second embodiment presents an advantage over the shredder of the first embodiment. That is to say, with the first rolling blade wheel group 10, 11 being used to chop paper documents, the third rolling blade wheel group 121, 122 can be used to chop compact discs. When one of the first and third rolling blade wheel groups 10, 11, 121, 122 is out of work, the second rolling blade wheel group 101, 111 could be used to chop paper documents and automatically release the jammed objects from the first rolling blade wheel group 10, 11 and/or the third rolling blade wheel group 121, 122.

Figure 5:
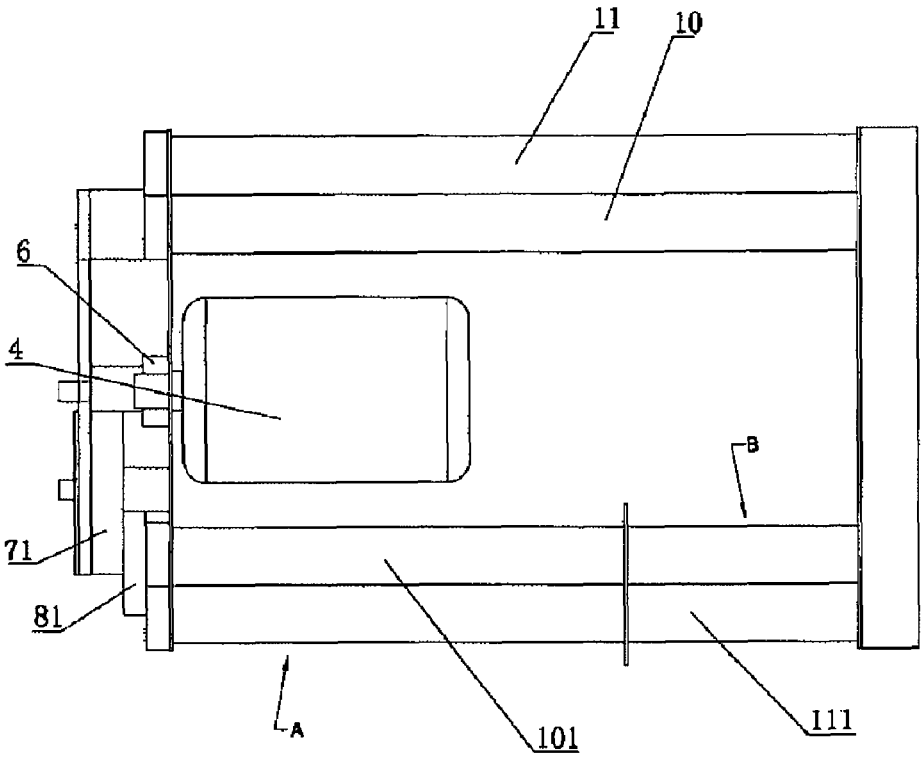
FIG. 5 depicts a top plane view of a shredding mechanism for use in a shredder according to a third embodiment of the present invention.

Referring to FIG. 5, a third embodiment of the present invention is provided. Compared with the first embodiment of the present invention, the third embodiment of the present invention provides a different second rolling blade wheel group 101, 111.

Figure 6:
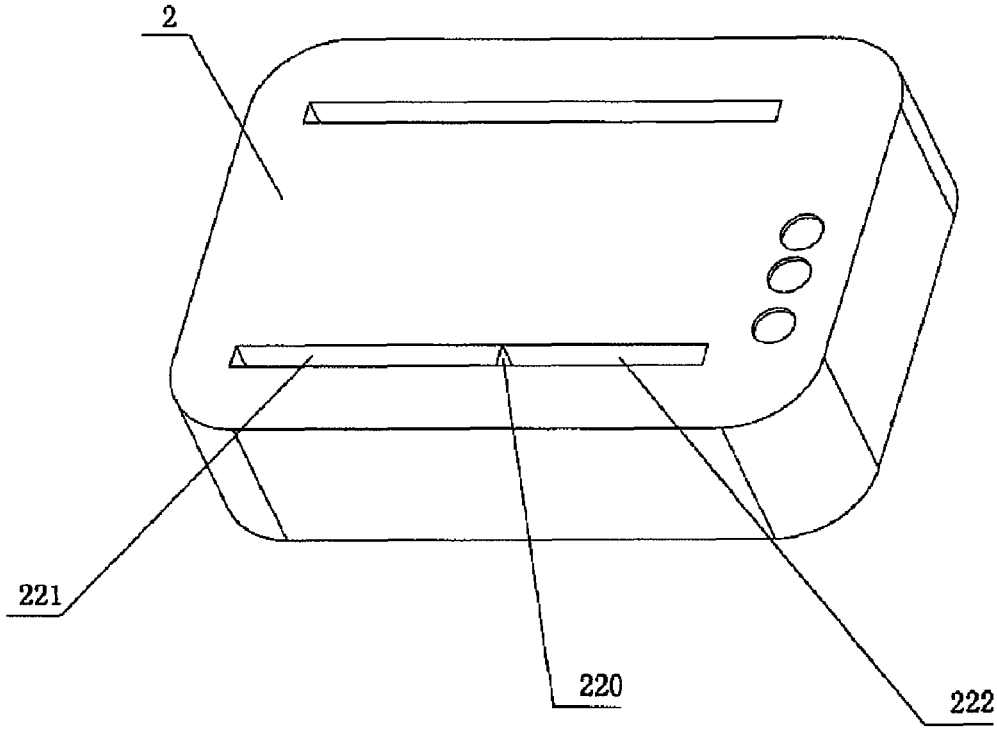
FIG. 6 depicts a top plane view of a shell for housing the shredding mechanism as shown in FIG. 5.

FIG. 5 illustrates the second rolling blade wheel group 101, 111. Each rolling blade wheel of the second rolling blade wheel group 101, 111 form two shredding areas A, B. The number of blade rows and the number of rolling blades in each blade row of the shredding area A are different from those of the shredding area B. Therefore, the second rolling blade wheel group 101, 111 can shred two different kinds of objects without any new driving mechanism being introduced. Referring to FIG. 6, a plate 220 formed on the shell 2 extends into the feeding opening corresponding to the second rolling blade wheel group 101, 111, to divide the feeding opening into two separate openings 221, 222, which can prevent the objects from jamming between the shredding areas A and B. Therefore, the second rolling blade wheel group 101, 111 can be configured as a double-functional rolling blade wheel group.

Alternatively, the first driving mechanism 7, 8 and the first rolling blade wheel group 10, 11 in FIG. 1 could be omitted. A shredder having a motor 4, a main gear 6, a second driving mechanism 71, 81 and a double-functional rolling blade wheel group 101, 111 could perform multi-functions.

Consequently, the double-functional rolling blade wheel group 101, 111 can improve the functions of the shredder without remarkably increasing the volume.

Figure 7:
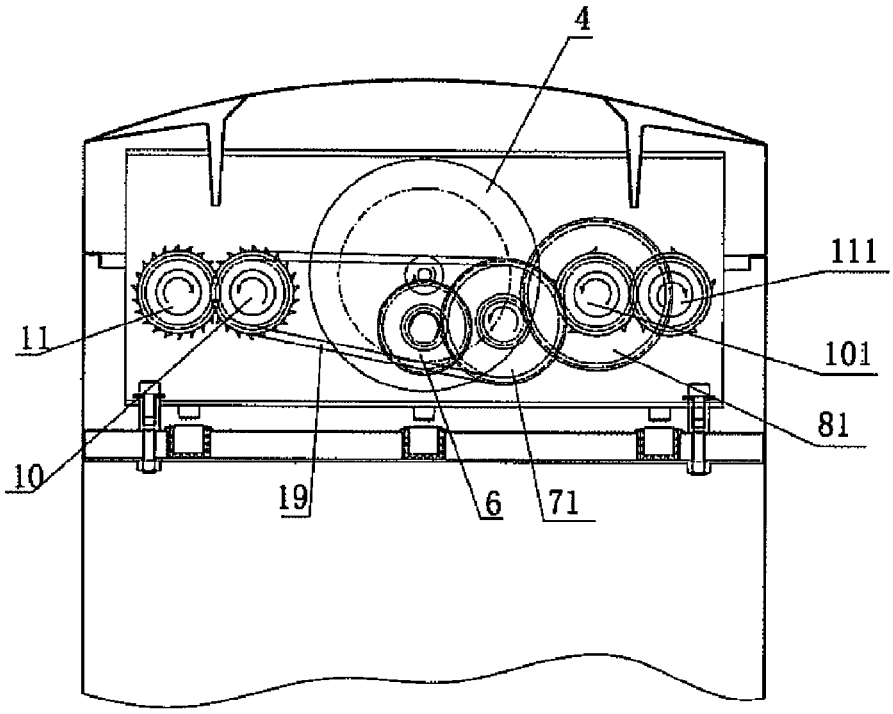
FIG. 7 depicts a side view of a shredder mechanism equipped with improved driving mechanism according to the present invention, showing the shredder from a side as same as that shown in FIG. 1.

Further referring to FIG. 7, in the embodiments as set forth previously, the driving mechanisms are disposed in a symmetrical manner. However, it is understood that the embodiments described above are intended to illustrate rather than limit the invention. Variations of part of symmetrical configurations may be made by one ordinary skilled in the art. The variations remaining symmetrical configurations do not depart from the spirit of the present invention and, therefore, should be covered in the spirit of the invention.

In FIG. 7, the motor 4, the main gear 6, the second driving mechanism 71, 81 and the second rolling blade wheel group 101, 111 are remained. The main gear 6 acts as a connecting gear. The driving gear 7 and the passive gear 8 are replaced with a belt 19 or a chain. The belt 19 or the chain connects the driving gear 71 of the second driving mechanism 71, 81 to the rolling blade wheel 10 of the first rolling blade wheel group 10, 11. When the belt 19 is used, the driving gear 71 and the first rolling blade wheel group 10, 11 form smooth surfaces respectively to engage with the belt. When the chain is used, the driving gear 71 and the first rolling blade wheel group 10, 11 form teeth respectively to engage with the chain. To adjust the speed of the first rolling blade wheel group 10, 11 relative to the second rolling blade wheel group 101, 111, the belt 19 can engage with different gears of the second driving mechanism 71, 81.

Figure 8:
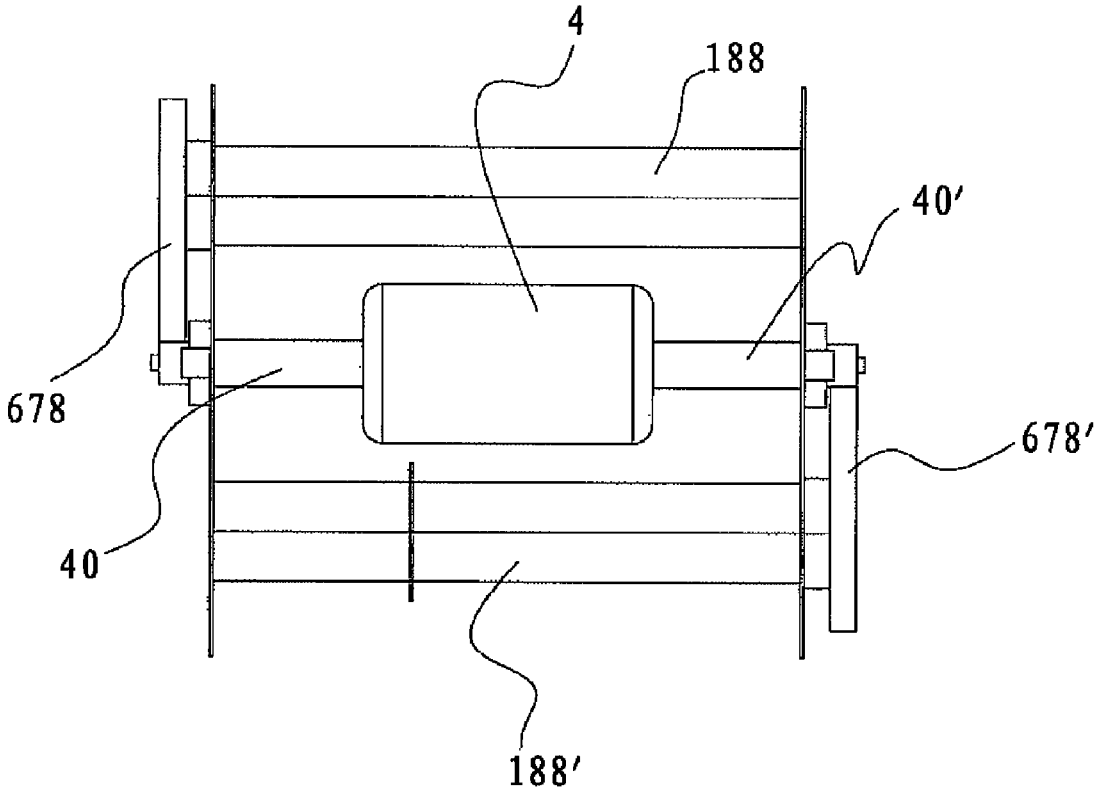
FIG. 8 depicts a top side view of a shredding mechanism for use in a shredder in accordance with a forth embodiment of the present invention.

Referring to FIG. 8, a shredder in accordance with a forth embodiment of the present invention is provided. A motor 4 of the shredder forms two output axes. A first driving mechanism 678 and a second driving mechanism 678' are arranged on opposite sides of the motor 4. As illustrated in FIG. 8, a first rolling blade wheel group 188 and a second rolling blade wheel group 188' are respectively arranged on an upper section and a lower section, and the motor 4 is arranged between the first and second rolling blade wheel groups 188, 188'. The output axes 40, 40' extend horizontally. The first driving mechanism 678 connects the left output axis 40 with the first rolling blade wheel group 188. The second driving mechanism 678' connects the right output axis 40' to the second rolling blade wheel group 188'. Therefore, a stable configuration is formed and the two rolling-blade wheel groups 188, 188' can rotate to perform shredding and jamming relief. Alternatively, one of the rolling blade wheel groups 188, 188' could also be configured as the above-mentioned double-functional rolling blade wheel group, with a corresponding feeding opening being defined to perform multiple functions.

Figure 9:
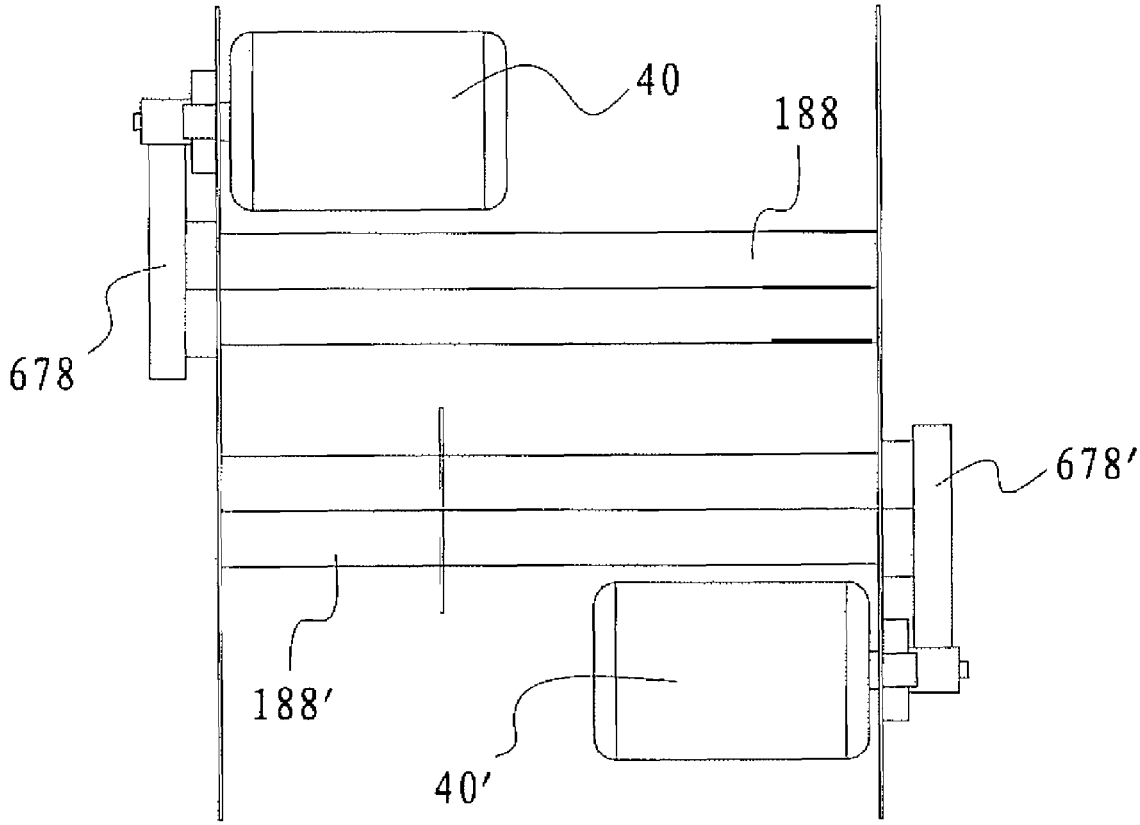
FIG. 9 depicts a top side view of a shredding mechanism for use in a shredder in accordance with a fifth embodiment of the present invention.

Referring to FIG. 9, a shredder in accordance with a fifth embodiment of the present invention is improved from the shredder in FIG. 8. Two motors 4, 4' are utilized to replace the motor 4 with two output axes in FIG. 8. The driving mechanisms 678, 678' are remained. The rolling blade wheel groups 188, 188' are disposed in a middle portion with the rolling blade wheel groups 188, 188' connecting with the driving mechanisms 678, 678' respectively. The motors 4, 4' are disposed at two outer sides of the rolling blade wheel groups 188, 188'. Consequently, synchronous rotations of the rolling blade wheel groups 188, 188' are realized. Additionally, one of the rolling blade wheel groups 188, 188' could also be configured as a double-functional rolling blade wheel group. A feeding opening is correspondingly defined in the shell (not shown in FIG. 9), thereby obtaining a multi-functional shredder.

In view of the above descriptions, the shredding mechanism according to the present invention overcomes the shortcomings of the conventional shredding mechanism and improves the functions of the shredder. Additionally, the shredder having improved shredding mechanism in accordance with the present invention can perform at least two shredding functions, thereby meeting different shredding needs and ensuring the working stability of the shredder.

While the present invention has been illustrated by the above description of the preferred embodiments thereof, while the preferred embodiments have been described in considerable detail, it is not intended to restrict or in any way limit the scope of the appended claims to such details. Additional advantages and modifications within the spirit and scope of the present invention will readily appear to those skilled in the art. Therefore, the present invention is not limited to the specific details and the illustrative examples shown and described.

What is claimed is:

1. A multi-functional shredder, comprising a shell and a shredding mechanism housed in the shell, wherein the shredding mechanism comprises a motor, a first rolling blade wheel group, a second rolling blade wheel group, a gear, a first driving mechanism and a second driving mechanism, an output axis of the motor engages with the gear, the gear engages with the first driving mechanism and the second driving mechanism respectively, the first and second driving mechanisms correspondingly connect with the first and second rolling blade wheel groups, the shell defines feeding openings corresponding to the first rolling blade wheel group and the second rolling blade wheel group: the motor is disposed between the first rolling blade wheel group and the second rolling blade wheel group; and wherein the shredding mechanism further comprises a third rolling blade wheel group juxtaposed to the motor disposed between the first rolling blade wheel group and the second rolling blade wheel group, a third driving mechanism is provided to couple the third rolling blade wheel group with the second rolling blade wheel group, and the shell is provided with a feeding opening corresponding to the third rolling blade wheel group.

2. The multi-functional shredder of claim 1, wherein the number of blade rows arranged along a circumference direction of the first rolling blade wheel group and the number of rolling blades in each blade row arranged along a longitudinal direction of the first rolling blade wheel group are different from those on the second rolling blade wheel group.

3. The multi-functional shredder of claim 1, wherein the first driving mechanism and the second driving mechanism are both configured as gears.

4. The multi-functional shredder of claim 3, wherein one of the driving mechanisms comprises a belt or a chain, one end of the belt or the chain connects to one rolling blade wheel and the other end of the belt or the chain connects with a gear of another driving mechanism.

* * * * *